US005189764A

United States Patent [19]

Herrington et al.

[11] Patent Number: 5,189,764

[45] Date of Patent: Mar. 2, 1993

[54] PLASTIC RECLOSABLE FASTENER WITH STRUCTURE FOR RETAINING SLIDER IN CLOSED POSITION

[75] Inventors: Fox J. Herrington, Holcomb; Eric A. St. Philips, Fairport, both of N.Y.

[73] Assignee: Mobil Oil Corporation, Fairfax, Va.

[21] Appl. No.: 873,537

[22] Filed: Apr. 22, 1992

Related U.S. Application Data

[63] Continuation of Ser. No. 674,648, Mar. 22, 1991, abandoned.

[51] Int. Cl.[5] ..... A44B 19/16

[52] U.S. Cl. ..... 24/387; 24/399

[58] Field of Search ..... 24/399, 400, 418, 387, 24/390, 388

[56] References Cited

U.S. PATENT DOCUMENTS

| | | | |
|---|---|---|---|
| 2,287,349 | 6/1942 | Hirsch | 24/418 |
| 3,103,049 | 9/1963 | Hawley . | |
| 3,122,807 | 3/1964 | Ausnit . | |
| 3,220,076 | 11/1965 | Ausnit et al. . | |
| 3,259,951 | 7/1966 | Zimmerman . | |
| 3,347,298 | 10/1967 | Ausnit et al. . | |
| 3,426,396 | 2/1969 | Laguerre . | |
| 3,462,332 | 8/1969 | Goto . | |
| 3,579,747 | 5/1971 | Hawley . | |
| 3,660,875 | 5/1972 | Gutman . | |
| 3,713,923 | 1/1972 | Laguerre . | |
| 3,790,992 | 2/1974 | Herz . | |
| 3,806,998 | 4/1974 | Laguerre . | |
| 4,262,395 | 4/1981 | Kosky . | |
| 4,517,710 | 5/1985 | Beckmann . | |
| 4,736,451 | 4/1988 | Ausnit . | |
| 4,825,514 | 5/1989 | Akeno | 24/387 X |

FOREIGN PATENT DOCUMENTS

| | | | |
|---|---|---|---|
| 648191 | 9/1962 | Canada | 24/400 |
| 844815 | 6/1970 | Canada | 24/418 |
| 1109532 | 1/1956 | France . | |
| 1144870 | 10/1957 | France | 24/387 |
| 375235 | 1/1940 | Italy . | |
| 300325 | 10/1954 | Switzerland | 24/399 |
| 914203 | 12/1962 | United Kingdom . | |
| 914204 | 12/1962 | United Kingdom . | |
| 1139838 | 1/1969 | United Kingdom . | |

*Primary Examiner*—James R. Brittain

*Attorney, Agent, or Firm*—Alexander J. McKillop; Charles J. Speciale

[57] ABSTRACT

Latching means is provided for retaining a plastic slider in closed position when the slider reaches the closed end of its travel along a zipper. The latching means disclosed is in the form of a detent on the plastic slider which engages with a protrusion on the zipper track to provide the feel of a secure closure and retain the slider in a closed position.

3 Claims, 2 Drawing Sheets

PLASTIC RECLOSABLE FASTENER WITH STRUCTURE FOR RETAINING SLIDER IN CLOSED POSITION

This is a continuation of copending application Ser. No. 07/674,648, filed on Mar. 22, 1991 abandoned.

BACKGROUND OF THE INVENTION

The present invention relates to improvements in plastic reclosable fasteners with sliders for opening and closing the reclosable fasteners on plastic bags and the like and particularly to latching structure for retaining the slider in closed position when the slider reaches the closed end of its travel along the reclosable fastener.

A conventional metal zipper has a tab on its slider. Folding down the tab locks the zipper so it will not unzip. Applicants know of no corresponding feature on a plastic zipper. Plastic zippers with sliders are well known in the art. The plastic zippers have profiles and include a pair of male and female fastener elements in the form of reclosable interlocking rib and groove elements with a slider for opening and closing the rib and groove elements. In the manufacture of thermoplastic film bags, a pair of these male and female fastener elements extend along the mouth of the bags and these male and female elements are adapted to be secured in any suitable manner to the flexible walls of the thermoplastic film bag. These elements may be integral marginal portions of such walls or they may be extruded separately and thereafter attached to the walls along the mouth of the bag. A method of continuously providing such a fastener on the thermoplastic film is disclosed in U.S. Pat. No. 3,462,332. The U.S. Pat. 3,259,951 discloses an example of a thermoplastic bag where the fastener elements are extruded separately and thereafter attached to the walls along the mouth of the bag. This patent also discloses a slider and flexible closure strips adapted to be joined by such slider to form an air tight closure.

The sliders for opening or closing the reclosable fasteners are adapted to be assembled with the fastener or zipper by an endwise assembly or by a relative transverse maneuver. An example of a fastener with an endwise assembly of the slider is disclosed in the aforesaid patent 3,259,951. In some instances the sliders are formed of multiple parts and assembled on the zipper. The assembly may be simplified if the slider is formed of one part and the sides are foldable into position when assembled on the zipper.

RELATED APPLICATIONS

Foldable plastic sliders are disclosed in the related application entitled "Foldable Zipper Slider with Compression-Type Latch" Serial No. 673,711, filed Mar. 22, 1991, the related application entitled "Gull Wing Zipper Slider" Ser. No. 490,106 filed Mar. 7, 1990 and in the related application entitled "Foldable Plastic Slider and Method of Assembly with a Plastic Reclosable Fastener" Ser. No. 490,108 filed Mar. 7, 1990, now U.S. Pat. No. 5,010,627. Another plastic zipper and slider is disclosed in the related application entitled "Rolling Action Zipper Profile and Slider Therefor" Ser. No. 490,110 filed Mar. 7, 1990, now U.S. Pat. No. 5,007,143.

Sliders formed of multiple parts and assembled on the zipper are disclosed in the related application entitled "Method of Assembling a Snapped-Together Multi-Part Plastic Slider with a Plastic Reclosable Fastener" Ser. No. 490,107 filed Mar. 7, 1990, now U.S. Pat. No. 5,007,142 and in the related application entitled "Method of Assembling a Multi-Part Plastic Slider with a Plastic Reclosable Fastener by Ultrasonic Welding" Ser. No. 490,109 filed Mar. 7, 1990.

A plastic reclosable fastener with self-locking slider is disclosed in the related application entitled "Plastic Reclosable Fastener with Self-Locking Slider" Ser. No. 673,707 filed Mar. 22, 1991. Another related application is entitled "Protruding End Stops for Plastic Reclosable Fastener" Ser. No. 673,706, filed Mar. 22, 1991. The disclosures in all of the above related applications are incorporated herein by this reference thereto. All of these applications are assigned to the same assignee as the present application.

SUMMARY OF THE INVENTION

It is an object of the present invention to provide a plastic bag having a zipper that is operated by a slider wherein cooperating latching structure is provided on the zipper and the slider to provide the feel of a secure closure when the slider has reached the closed position on the zipper.

The present invention relates to a plastic reclosable fastener with a self-latching slider particularly suited for plastic bags and the like for closing or opening the reclosable fastener and for providing the feel of a secure closure when the slider is in the closed position. The reclosable fastener comprises a pair of flexible plastic strips having separable fastener means extending along the length thereof comprising reclosable interlocking male and female profile elements on the respective strips. The male and female elements have complimentary cross-sectional shapes such that they are closed by pressing the elements together. A straddling slider is positioned on the strips for closing the reclosable male and female elements. Latching means is provided for retaining the slider in closed position when the slider reaches the closed end of its travel along the plastic strips comprising cooperating detent structure on the slider and at least one of the plastic strips, the detent structure being engageable when the slider is at the closed end of its travel on the plastic strips. In one form of the invention the cooperating detent structure comprises notched structure on the slider and cooperating protrusion structure on the at least one plastic strip.

DESCRIPTION OF THE PREFERRED EMBODIMENT

Figure 1:
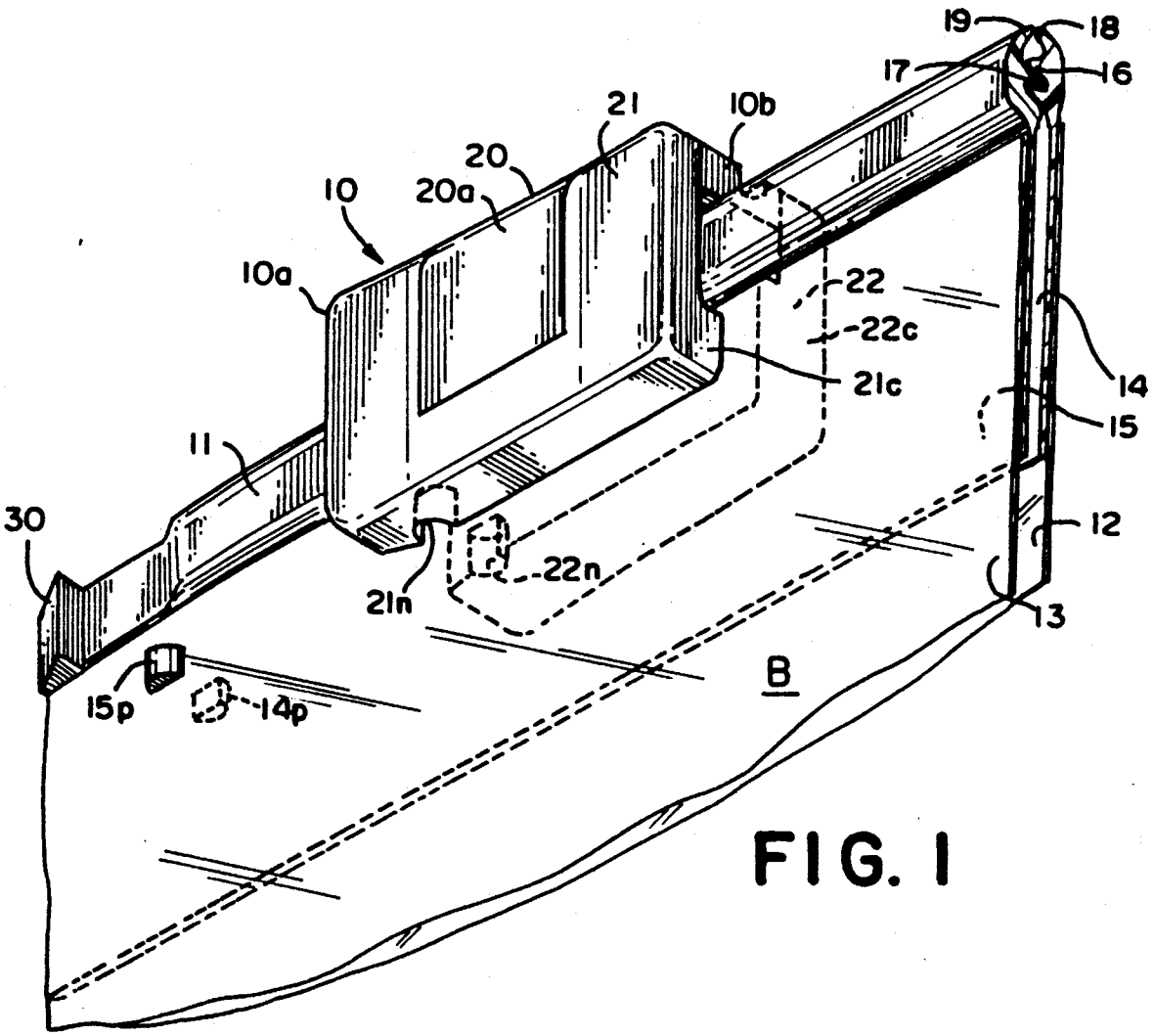
FIG. 1 is a fractional perspective view of a plastic bag with a plastic reclosable fastener and slider constructed in accordance with invention.

Referring to FIG. 1, there is illustrated a plastic slider 10 and a profiled plastic reclosable fastener or zipper 11 embodying the present invention. The slider 10 and zipper 11 are particularly suited for thermoplastic bags and the like and the slider 10 has been illustrated in FIGS. 1 and 2 assembled on the zipper 11 at the top edge or mouth of a thermoplastic bag B. The bag B may be made from any suitable thermoplastic film such for example as polyethylene or polypropylene or equivalent material. The bag B is formed by a pair of flexible plastic sheets 12 and 13 joined at the bottom and having a top edge, with a pair of flexible plastic strips 14 and 15 having separable plastic means extending along the length thereof comprising reclosable interlocking male and female profile elements in the form of rib and groove elements 16 and 17 on the respective strips to form the zipper 11. The strips 14 and 15 may be extruded separately and attached to the respective sides of the bag mouth or the strips 14 and 15 may be extruded integral with the sides of the bag mouth. The strips 14 and 15 include profiled tracks 18 and 19 extending along the length thereof parallel to the rib and groove elements 16 and 17 and the rib and groove elements, 16, 17 have complementary cross-sectional shapes such that they are closed by pressing the elements together with the slider 10. The cross-sectional shapes of the interlocking male and female elements having the rib and groove profiles 16 and 17 may be of any type but preferably are of the type disclosed and claimed in the aforesaid related application entitled "Rolling Action Zipper Profile and Slider Therefor" Ser. No. 490,110 now U.S. Pat. No. 5,007,143.

It is to be understood that the present invention is not limited to the shapes of the rib and groove profiles illustrated herein and that other shapes can be utilized in connection with the present invention. It is also to be understood that the present invention is not limited to the particular construction of the slider 10 disclosed herein and that other zipper sliders may be utilized in connection with the present invention including those referred to in the aforesaid related applications.

As may be seen in FIG. 1 the slider 10 straddles the zipper 11 at the top of the bag B and is adapted for opening or closing the reclosable fastener element 16 or 17 of the zipper 11. For purposes of explanation, the slider 10 is similar to the construction described in more detail in the aforesaid related application Ser. No. 673,707. The slider 10 is formed from a single piece of molded plastic comprising a separator finger 9, FIG. 2, and interlocking complementary structure moving along the zipper 11. The slider 10 may be molded from any suitable plastic such for example as nylon, polypropylene, polystyrene, Delrin or ABS.

In the preferred embodiment the complementary structure comprises an inverted U-shaped member including a transverse supported member or body 20 from which the separator finger 9 depends. The body 20 is itself U-shaped and includes two integral spaced depending legs **20*a* and 20*b* (not shown). The finger 9 is positioned between the legs 20*a*, 20*b*. The body 20 is adapted to move along the top edges of the tracks 18 and 19 with the legs 20*a*, 20*b* straddling these elements and the finger 9 positioned between the tracks 18 and 19. The body 20 also includes a pair of hinged "wings" or side walls 21 or 22 that can be folded down into their final position. The wings 21 and 22 are hinged to the main slider body 20 by means of hinge structure located at the opposite ends of the legs 20*a* and 20*b*. The wings 21 and 22 have central openings into which the legs 20*a*, 20*b* extend and the wings 21 and 22 are folded down into their final position as shown in FIG. 1. When the sidewalls 21 and 22 are in the folded position as shown in FIG. 1 a compression-type latching mechanism (not shown) locks the sidewalls 21 and 22 in folded position with the depending legs 20*a* and 20*b*. In this assembled position, the shoulders 21*c* and 22*c* on the sidewalls 21 and 22 are positioned beneath the bottom of the fastener elements 16 and 17 to prevent the slider 10 from being lifted off the zipper 11. The foldable depending sidewalls 21 and 22 extend from an opening end 10*a* of the slider 10 to a closing end 10*b*. The sidewalls 21 and 22 and the depending legs 20*a* and 20*b* are spaced wider apart at the opening end 10*a* of the slider 10 to permit the separation of the rib and groove elements 16 and 17 by the finger 9 engaging the tracks 18 and 19 and are spaced sufficiently close together at the closing end 10*b* of the slider to press the rib and groove elements 16 and 17 into interlocking relationship as the slider 10 is moved in a fastener closing direction from the position in FIG. 1 to the closed position in FIG. 2**.

Figure 2:
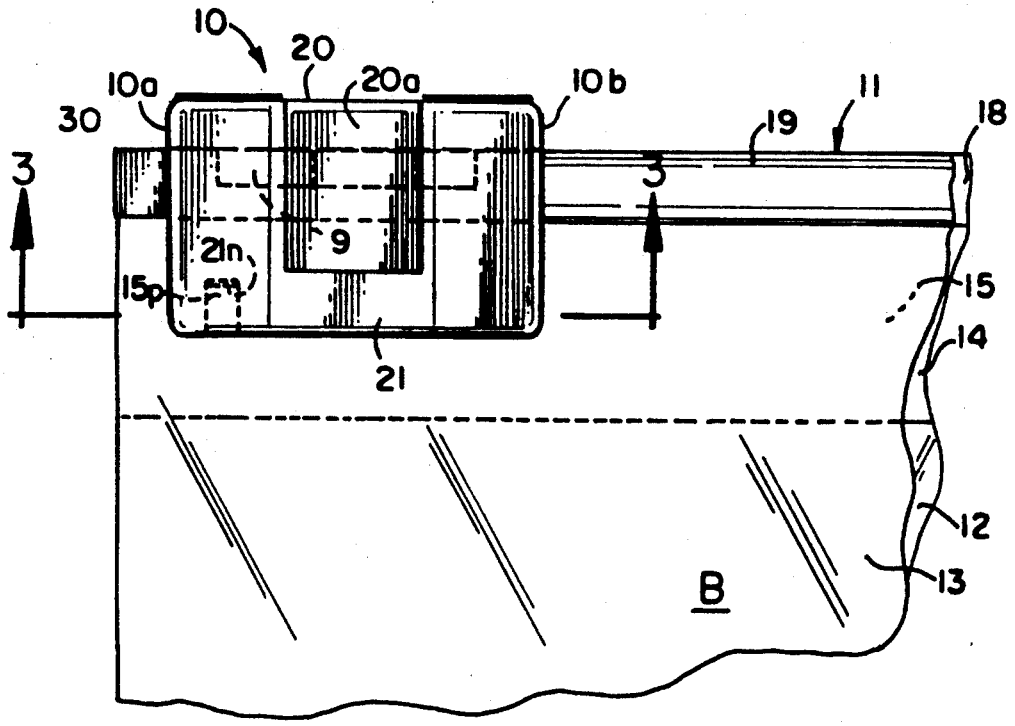
FIG. 2 is an elevational view of the slider and one end of the reclosable fastener shown in FIG. 1.
Figure 3:
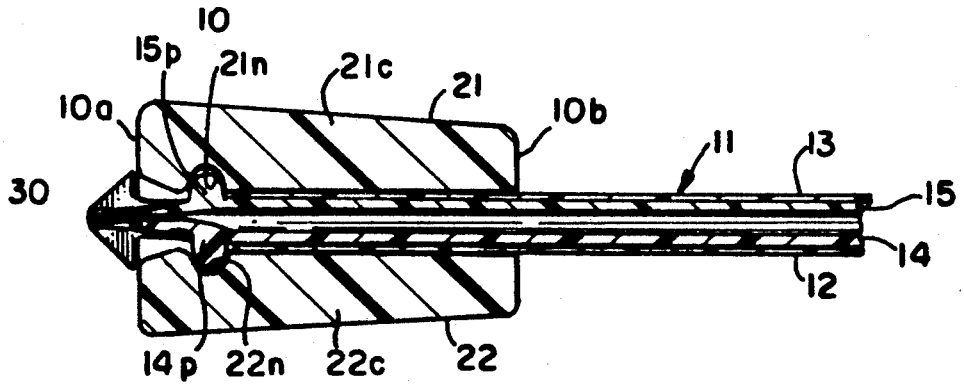
FIG. 3 is a sectional view taken along the lines 3—3 in FIG. 2.

As may be seen in FIGS. 1–3 the extruded strips 14 and 15 have been provided with protrusions **14*p* and 15*p* which extend outwardly from the surface of the strips 14 and 15. The protrusions 14*p* and 15*p* are shaped to be received within the corresponding notches or indentations 21*n* and 22*n* formed in the lower portions of the sidewalls 21 and 22 of the slider 10. As may be seen in FIGS. 1 and 3 the notches 21*n* and 22*n* are formed in the opposed vertical surfaces of the shoulders 21*c* and 22*c*. The ends of the notches 21*n* and 22*n* are flared at the opening end 10*a* of the slider 10, FIG. 3, to provide a funnel shaped opening to permit the protrusions 14*p* and 15*p* to enter the notches 21*n* and 22*n* as the slider 10 moves to the closed end of the zipper 11, FIGS. 2 and 3. The protrusions 14*p* and 15*p* are spaced with respect to the closed end of the zipper 11 so that when the slider 10 reaches the end of its travel on the zipper 11 in the closing direction, the protrusions 14*p* and 15*p* will be received in the notches or indentations 21*n* and 22*n*. This gives the user of the bag assurance that the bag is closed with certainty. If the zipper 11** is not provided with end stops the cooperating protrusions and notches will serve to keep the slider from going past the closed end of the zipper and coming off of the bag.

The opposite ends of the zipper 11 may be provided with end stops 30 formed from the material at the opposite ends of the zipper 11 and protrude from the zipper a distance adequate to engage the slider 10 to prevent the slider from going past the respective ends of the zipper and coming off of the bag. This construction is described in more detail in the aforesaid related application Ser. No. 673,706. When the zipper 11 is provided with end stops 30 the protrusions **14*p* and 15*p* are spaced with respect to the closed end stop 30 of the zipper 11 so that when the slider 10 reaches the end of its travel on the zipper 11 in the closing direction, the protrusions 14*p* and 15*p* will be received in the notches or indentations 21*n* or 22*n***.

While one type of cooperating detent structure has been described and illustrated in respect to the slider and the plastic strips, it is to be understood that other cooperating detent structure may be utilized for performing the same function, namely providing the user of the bag with the feel of a secure closure. The protrusions and indentations disclosed herein for providing the cooperating detent structure may be positioned at other locations than those shown without departing from the spirit of the invention and the scope of the claims.

What is claimed is:

1. A plastic reclosable fastener with a slider particularly suited for thermoplastic bags and the like comprising a pair of flexible plastic strips having separable fastener means extending along the length thereof comprising reclosable interlocking male and female profile elements on the respective strips, said male and female elements having complementary cross sectional shapes such that they are closed by pressing the elements together, a straddling plastic slider on said strips for closing the reclosable male and female elements, and latching means for retaining said slider in closed position when said slider reaches the closed end of its travel along said plastic strips comprising cooperating detent structure on said slider and at least one of said plastic strips, said detent structure on said at least one plastic strip being located on the outer surface thereof and below said interlocking male and female profile elements intermediate the ends of said profile elements and engageable with said detent structure on said slider when said slider is at the closed end of its travel on said plastic strips.

2. A plastic reclosable fastener with a slider according to claim 1 wherein said cooperating detent structure comprises notched structure on said slider and cooperating protrusion structure on said at least one plastic strip.

3. A plastic reclosable fastener with a slider according to claim 2 wherein a pair of notched structures are provided on said slider for cooperating with protrusion structures on both of said plastic strips.

* * * * *